US006118467A

United States Patent [19]

Park

[11] Patent Number: 6,118,467

[45] Date of Patent: Sep. 12, 2000

[54] PRINTING METHOD AND PRINTING APPARATUS CAPABLE OF PRINTING WITHOUT MARGINS

[75] Inventor: Keun-yong Park, Suwon, Rep. of Korea

[73] Assignee: Samsung Electronics Co., Ltd., Kyungki-do, Rep. of Korea

[21] Appl. No.: 08/313,794

[22] Filed: Sep. 28, 1994

[30] Foreign Application Priority Data

Sep. 29, 1993 [KR] Rep. of Korea ..... 93-20545

[51] Int. Cl.[7] ..... B41J 2/325

[52] U.S. Cl. ..... 347/176; 347/177; 347/218; 347/171

[58] Field of Search ..... 347/171, 172, 347/174, 176, 177, 218; 400/120.02, 120.04

[56] References Cited

U.S. PATENT DOCUMENTS

| | | | |
|---|---|---|---|
| 5,124,724 | 6/1992 | Hatakeyama et al. | 347/176 |
| 5,182,573 | 1/1993 | Kim | 347/176 |
| 5,255,012 | 10/1993 | Amano | 347/176 |
| 5,270,738 | 12/1993 | Takahashi et al. | 347/104 |
| 5,372,440 | 12/1994 | Slater | 347/176 |
| 5,492,061 | 2/1996 | Park et al. | 347/171 |

FOREIGN PATENT DOCUMENTS

| | | | |
|---|---|---|---|
| 0085777 | 5/1984 | Japan | 347/176 |
| 61-089058 | 5/1986 | Japan | 347/176 |
| 1-242268 | 9/1989 | Japan | 347/200 |
| 0344261 | 11/1992 | Japan | 347/176 |

*Primary Examiner*—Huan Tran

*Attorney, Agent, or Firm*—Sughrue, Mion, Zinn, Macpeak & Seas, PLLC

[57] ABSTRACT

A printing method for an apparatus printing in which a sheet of paper is positioned on a surface and printing is performed from the leading edge of the paper sheet to the bottom edge thereof with a printing head.

10 Claims, 5 Drawing Sheets

PRINTING METHOD AND PRINTING APPARATUS CAPABLE OF PRINTING WITHOUT MARGINS

BACKGROUND OF THE INVENTION

1. Field of the Invention

The present invention relates to a printing method and printing apparatus, and more particularly, to a printing method and printing apparatus in which an image is printed on a sheet of paper without top and bottom margins.

2. Description of the Related Art

Generally, a thermal transfer printer has a thermal printing head having a heating element, and a film-shaped ribbon coated with ink. Such a thermal transfer printer is constructed to have a transfer structure in which the ribbon is placed between a sheet of paper and the thermal printing head, and thus, ink sublimed in a predetermined pattern by the thermal printing head is shifted onto the sheet of paper. For full color, a color thermal transfer printer is designed to repeatedly print color-separated yellow, magenta and cyan images superimposed on one another.

In such a printer using an ink ribbon on which sublimation ink dyes of three (or four) colors such as yellow, magenta and cyan (and black) are sheet-sequentially coated, the leading edges of respective color portions must be sought for every revolution of a drum according to a printing signal so that the initial printing position of a sheet of paper coincides with the leading edges of respective color portions.

FIG. 1 shows important components of a conventional thermal transfer printer. A paper feeding cassette 6 is placed on one side under a drum 2. Guide rollers 3 guide paper sheet 4 supplied from paper feeding cassette 6 into contact with the drum and are provided around the circumference of drum 2. A clamp 5, for clamping the leading edge of paper sheet 4 and thereby conveying the paper sheet around drum 2, is provided on a drum shaft 2'. A thermal printing head 1 is installed above drum 2 and is capable of vertical movement (i.e., up and down). An ink ribbon 7 is placed between thermal printing head 1 and paper sheet 4 so that ink is sublimed due to the heat and pressure of thermal printing head 1, thereby causing an image to be printed on paper sheet 4.

In the printing method for the conventional thermal transfer printer discussed as above, first, paper sheet 4 is carried to drum 2 from cassette 6. When paper sheet 4 arrives beneath drum 2, clamp 5 clamps the leading edge of paper sheet 4. Subsequently, as clamp 5 and drum 2 rotate, the leading edge of paper sheet 4 is conveyed to a point slightly beyond thermal printing head 1 as shown in FIG. 1. Then, thermal printing head 1 is lowered to press/heat ink ribbon 7 so that ink is sublimed and thereby an image is printed on paper sheet 4.

In such a conventional thermal transfer printer, however, since paper sheet 4 is carried with the leading edge thereof being clamped by clamp 5, an image cannot be printed over the interval between clamp 5 and the initial printing position 10, that is, the distance "a" from the leading edge of paper sheet 4 (see FIGS. 1 and 2) because such printing would cause clamp 5 and printing head 1 to interfere with one another. This leaves a margin around a printed image, especially on the leading edge portion of paper sheet 4, resulting in a poor appearance and wasted paper.

SUMMARY OF THE INVENTION

In order to overcome the problems associated with conventional devices, it is an object of the present invention to provide a printing method and apparatus which is able to print an image even on the leading edge of a sheet of paper.

To accomplish the object of the present invention, there is provided a printing method for a thermal transfer printer which performs printing an image on a sheet of paper by thermally pressing an ink ribbon with a printing head, the method includes the steps of feeding the sheet of paper so that the paper sheet is positioned in a horizontal state; and printing from the leading edge of the paper sheet to the bottom edge thereof.

The invention includes a printing apparatus which performs printing an image on a sheet of paper by thermally pressing an ink ribbon with a printing head, the printing apparatus includes: a motor; a driving roller driven by the motor; a driven roller spaced apart from the driving roller by a predetermined distance; a belt wound around the driving roller and the driven roller; a head conveyor located above the belt and having the printing head. The paper sheet is supplied on the belt, and printing is carried out from the leading edge of the paper sheet to the bottom edge thereof.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE PREFERRED EMBODIMENTS

A printing method of the preferred embodiments includes a step of supplying a sheet of paper onto a flat plane, and a step of printing the sheet of paper from the leading edge thereof to the bottom thereof.

First, in the paper supplying step, a sheet of paper is supplied onto the flat plane from a paper feeding cassette. Then, in the printing step, a printing head is horizontally transferred while thermally pressing an ink ribbon from the leading edge of the paper sheet. This allows an image to be printed on the entire paper sheet.

Figure 9:
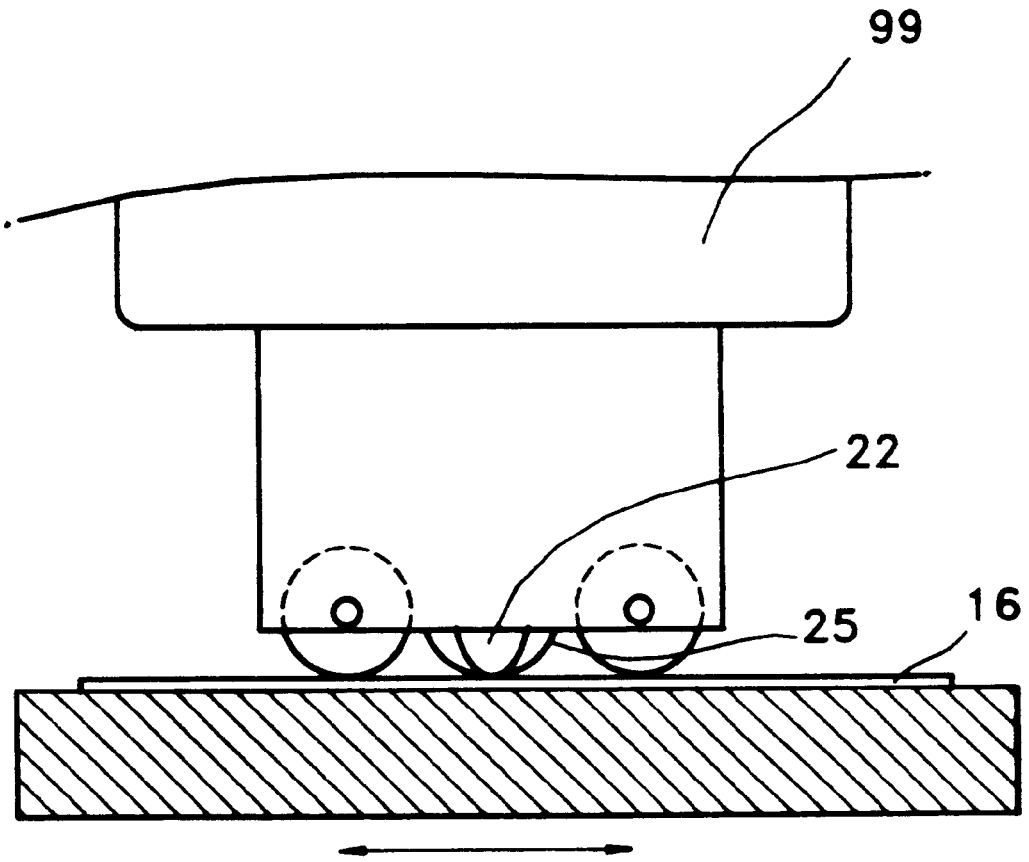
FIG. 9 illustrates another preferred embodiment of the printing apparatus of the present invention.

More specifically, a sheet of paper is supplied onto a horizontal plane and simultaneously, one color portion from among magenta, cyan, yellow and black of the ink ribbon is positioned at a corresponding position of the paper sheet. The printing head is transferred from the leading edge of the paper sheet to the bottom edge thereof while thermally pressing (i.e., heating and pressing) the ink ribbon. A printing signal is applied to the printing head in a known manner so that a selected color of an image is printed on the paper sheet. Next, in a state when the pressure of the printing head is released, the printing head returns to the leading edge of the paper sheet. Simultaneously, another color of the colors of the ink ribbon is disposed over the paper sheet, and the printing head is transferred from the leading edge of the paper sheet to the bottom edge thereof. The selected color is printed superposed with the first printed color. The other colors of the ink ribbon are sequentially printed in the same manner. As shown in FIG. 9, printing can be alternatively performed while a sheet of paper is conveyed underneath with a printing head 22 fixed onto a fixed block 99.

Alternatively, a first color is printed from the leading edge of paper sheet to the bottom edge thereof, a second color is printed from the bottom edge of the paper sheet to the leading edge thereof, and a third color is printed from the leading edge of the paper sheet to the bottom edge thereof.

The construction of a preferred embodiment of the printing apparatus will be described below.

Figure 1:
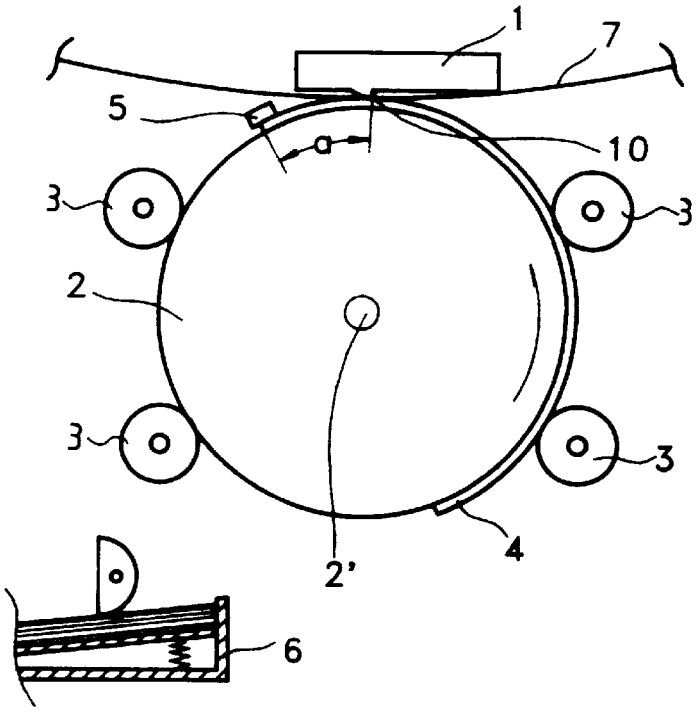
FIG. 1 (PRIOR ART)
FIG. 1 illustrates a conventional printing device and method.
Figure 2:
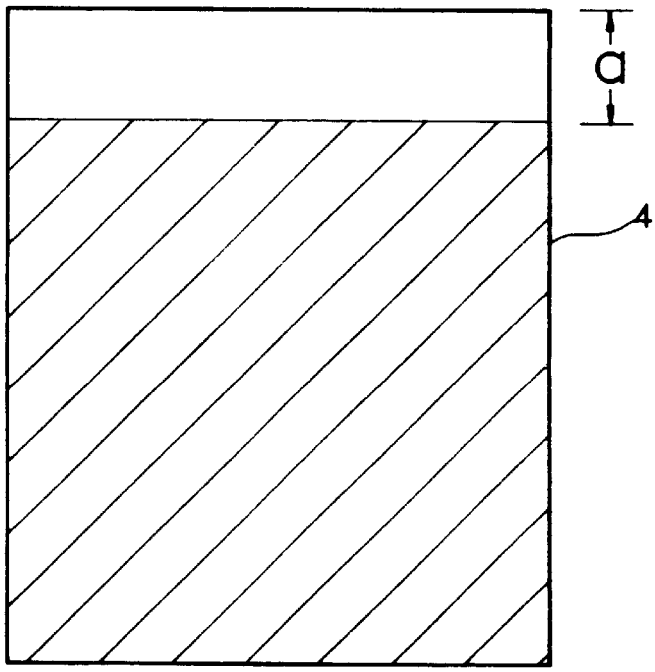
FIG. 2 (PRIOR ART)
FIG. 2 is a schematic representation of a sheet of paper printed according to the conventional printing method.
Figure 3:
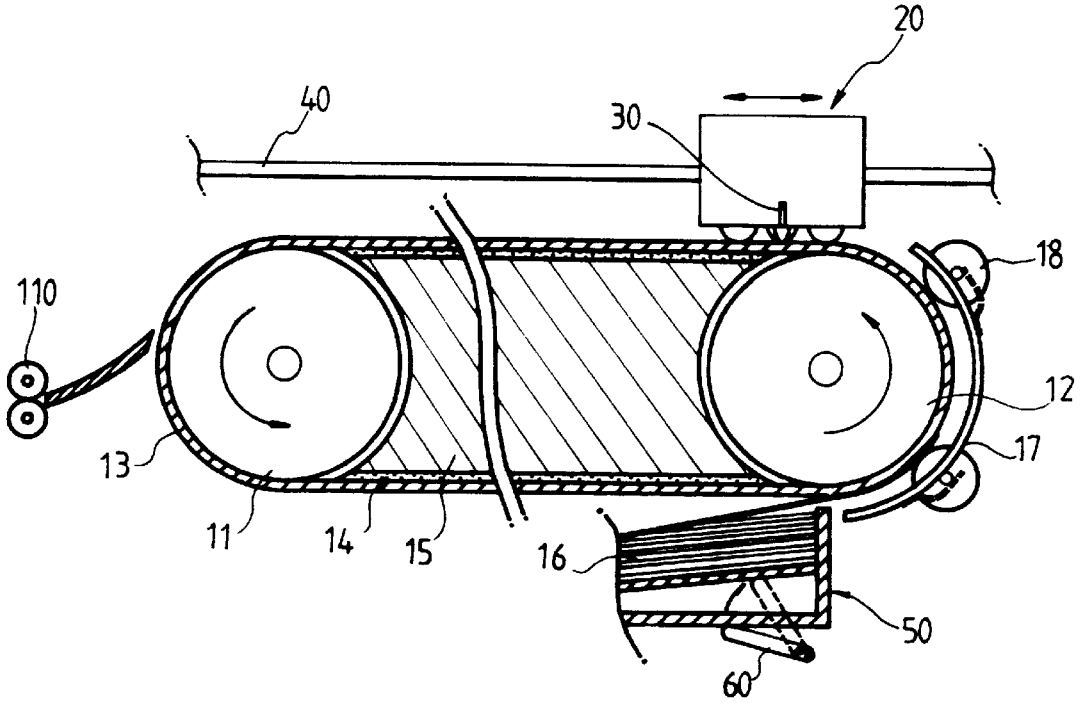
FIGS. 3, 4, 5 and 7 illustrate the operation of a printing apparatus of the preferred embodiment.
Figure 6:
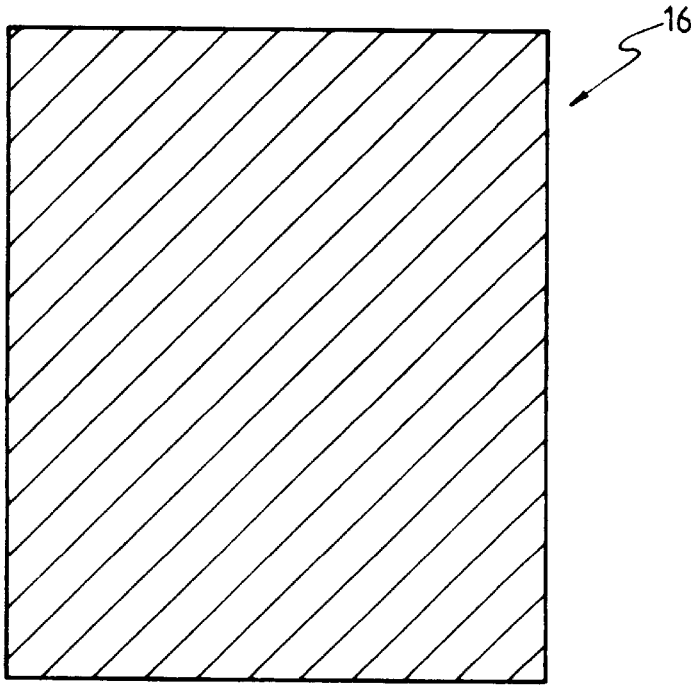
FIG. 6 is a schematic illustration of a sheet of paper printed according to a printing method of the preferred embodiment.

Referring to FIG. 3, a driving roller 11 driven by the force of a motor (not shown) is provided apart from a driven roller 12. A belt 13 is wound around rollers 11 and 12. A paper feeding cassette 50 containing sheets of paper 16 is placed on one side under driven roller 12. Guide rollers 18 are provided around the circumference of driven roller 12 in contact with belt 13. Guide rollers 18 are resiliently supported with respect to a support member 17. Here, paper sheet 16 is raised by a lift 60 located under paper feeding cassette 50 and supplied to belt 13. A guide rail 40 is disposed in parallel with belt 13 above belt 13. A head conveyor 20 having a printing head 22 is installed on guide rail 40 and can be carried along guide rail 40 by a separate conveying device.

Figure 5:
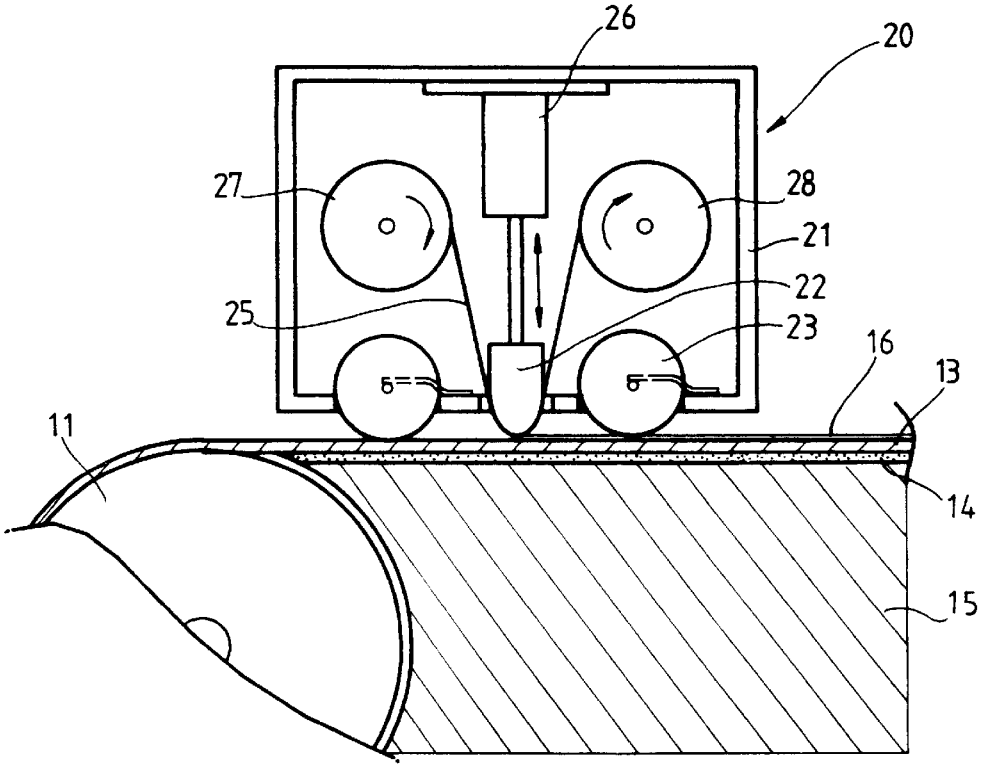

As shown in FIG. 5, head conveyor 20 is made up of a housing 21, an ink ribbon 25 on which sections of sublimation ink dyes are arranged in series, printing head 22, and a lifting device for raising/lowering printing head 22 so as to press/release ink ribbon 25 with printing head 22. Ink ribbon 25 is wound around supply reel 27 and take-up reel 28 at a predetermined velocity in one direction. The lifting device has a solenoid 26 coupled to printing head 22, in order to raise and lower printing head 22 by actuating the solenoid 26. Conveying rollers 23 for rolling while in contact with belt 13 are installed in housing 21 and facilitate the conveyance of head conveyor 20 and prevent paper sheet 16 from being pushed by the pressure and conveyance force of printing head 22 as it prints by pressing and heating ink ribbon 25 and paper sheet 16.

Figure 8:
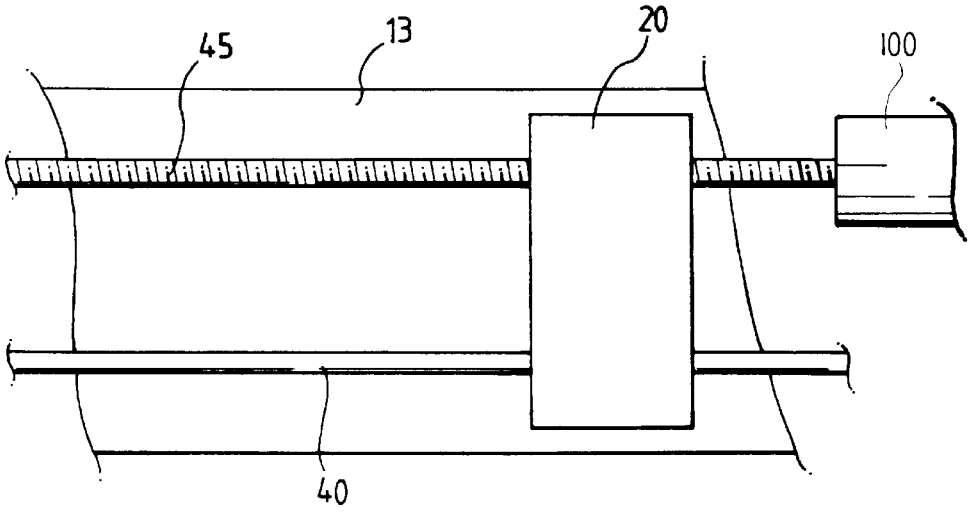
FIG. 8 is a plan view of the printing apparatus of the preferred embodiment.

The conveying device for carrying head conveyor 20, as shown in FIG. 8, includes guide rail 40 and a screw 45 disposed in parallel with belt 13, and motor 100 connected to screw 45 for supplying rotational force to screw 45. Head conveyor 20 is slid along guide rail 40 by the force of motor 100 because screw 45 is threadably engaged with head conveyor 20.

Pad member 15 is placed between the upper and lower portions of belt 13 to prevent belt 13 from being deformed by the pressure of printing head 22 when it prints by thermally pressing ink ribbon 25 and paper sheet 16. Here, anti-friction member 14 is interposed between belt 13 and pad member 15 to alleviate the friction generated between belt 13 and pad member 15 when the belt is driven.

Figure 4:
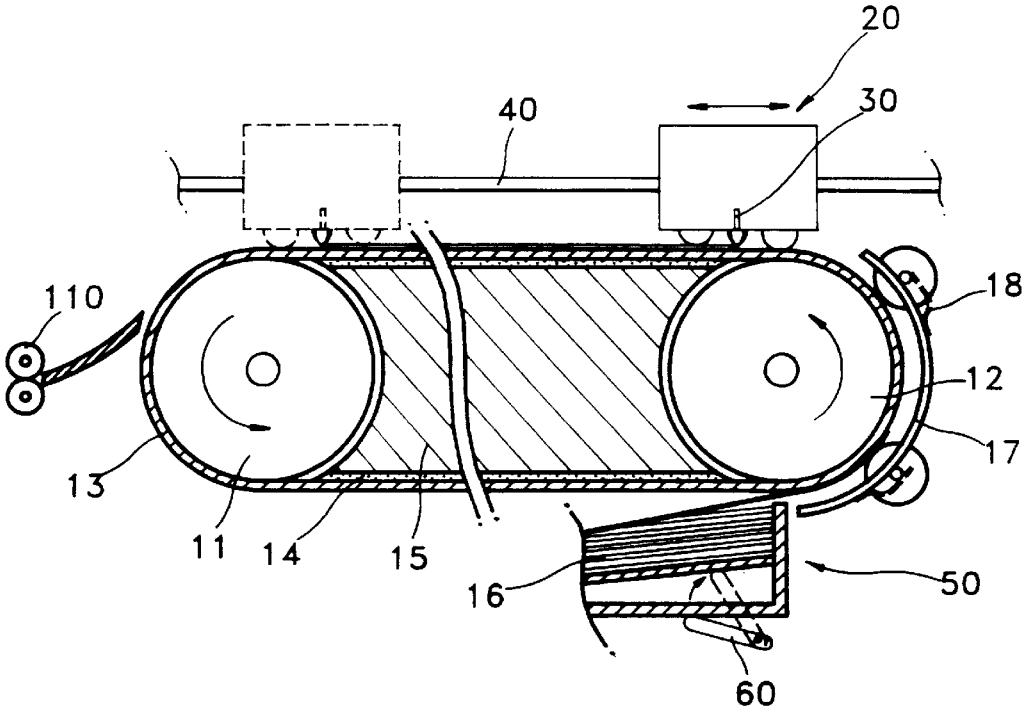
Figure 7:
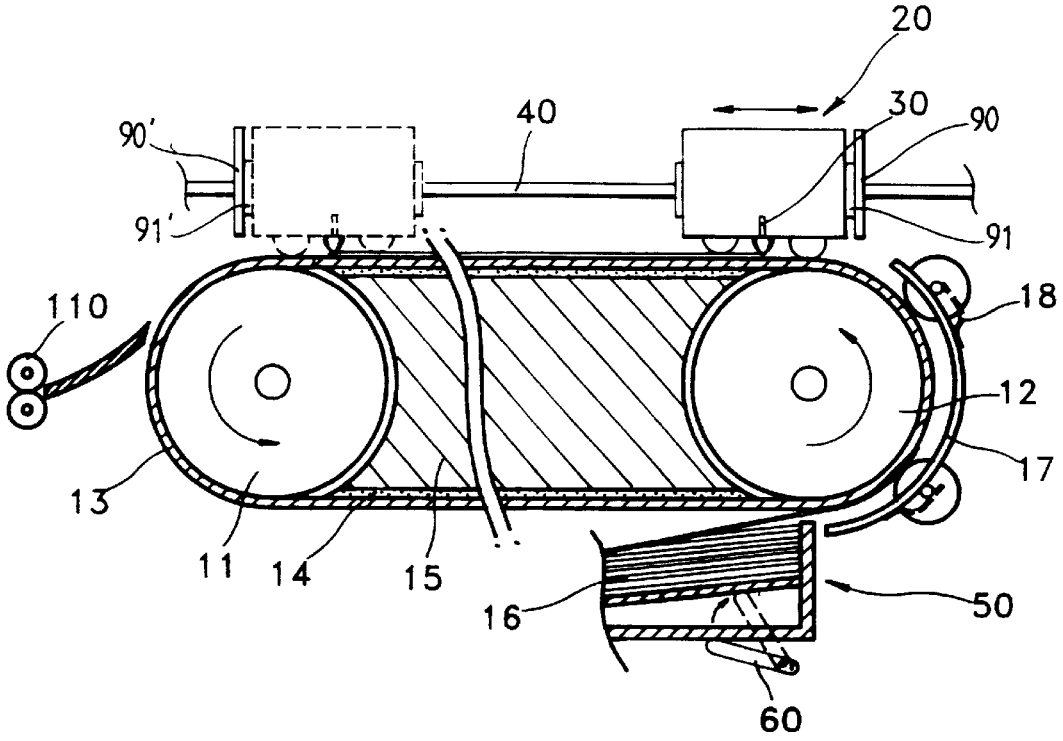

A detecting device for detecting the leading edge and bottom edge of paper sheet 16 is provided so that printing head 22 is precisely positioned on the leading edge and bottom edge of paper sheet 16 and that printing is performed from the leading edge of paper sheet 16 to the bottom edge thereof. For the detecting device, as shown in FIGS. 3 and 4, a sensor 30 for detecting the leading edge and bottom edge of paper sheet 16 can be installed on head conveyor 20. As shown in FIG. 7, sensors 91 and 91' can be additionally installed on stops 90 and 90' which serve to restrain the left and right movement of head conveyor 20 along guide rail 40. In this case, when head conveyor 20 makes contact with sensors 91 and 91', printing head 20 is precisely positioned on the leading edge or bottom edge of paper sheet 16. Further, a paper discharge roller 110 is installed on the paper exiting side. The various sensors can be coupled to the system controller in a known manner.

The operation of the printing apparatus of the preferred embodiment above will now be described.

First, referring to FIG. 3, paper sheet 16 is supplied from paper feeding cassette 50 located under belt 13 by lift 60 in response to a paper feeding signal. Paper sheet 16 supplied is transported while in contact with guide rollers 18 and belt 13. When paper sheet 16 is located on the top of belt 13, the belt stops.

Sequentially, a motor 100 (FIG. 8) is driven to carry head conveyor 20 to the leading edge of paper sheet 16. Here, when sensor 30 detects the leading edge of paper sheet 16, motor 100 stops in response to the detecting signal and therefore head conveyor 20 stops. Then, ink ribbon 25 is wound by a driving means (not shown) so that a color portion of the ribbon having a first color to be printed lies at a position corresponding to the paper sheet 16, i.e., is superposed over paper sheet 16. Solenoid 26 operates to lower printing head 22 and to thereby thermally press ink ribbon 25 and paper sheet 16 (see FIG. 5). Simultaneously, as shown in FIG. 4, as head conveyor 20 is carried, the selected color is printed from the leading edge of paper sheet to the bottom edge thereof through a known heat sablination technique, or the like.

Here, after the printing of the first selected color is finished, solenoid 26 operates to raise printing head 22, and motor 100 is driven in reverse to convey head conveyor 20 so that printing head 22 is transferred from the bottom edge of paper sheet 16 to the leading edge thereof. Then, another color portion of ink ribbon 25 is positioned to correspond to the paper sheet, and solenoid 26 operates so that printing head 22 thermally presses ink ribbon 25 and paper sheet 16 and thereby prints the second color from the leading edge of the paper sheet to the bottom edge thereof. Conveying rollers 23 are installed on both sides of printing head 22 and are in rolling contact with the top and bottom portions of paper sheet 16 to be printed. Therefore, paper sheet 16 is not pushed in the printing direction but stays flat on belt 13 during printing. Since sensor 30 detects the leading and bottom edges of the paper sheet and thereby provides control for motor 100, printing head 22 can be precisely stopped at either edge of paper sheet 16.

As shown in FIG. 7, when sensors 91 and 91' are respectively installed on stops 90 and 90', which are fixed to guide rail 40, the position of head conveyor 20 is detected by coming into contact with sensors 91 and 91' during movement. The detecting signal cycles the power to motor 100 on and off. This enables printing head 22 to stop precisely at the leading edge or bottom edge of paper sheet 16. Alternatively, sensors 91 and 91' can be noncontact sensors, such as photosensors, or the like.

In another embodiment of the printing apparatus of the present invention, first, in a state in which printing head 22 thermally presses ink ribbon 25 and paper sheet 16, head conveyor 20 is conveyed to print a first color from the leading edge of paper sheet 16 to the bottom edge thereof. Subsequently, after the completion of printing the first color, printing head 22 is raised by solenoid 26 at the bottom edge of paper sheet 16, and a second color of ink ribbon 25 is positioned to correspond to paper sheet 16. In this state, printing head 22 is lowered and head conveyor 20 is conveyed by the driving of motor 100 so that the printing head prints the second color from the bottom edge of the paper sheet to the leading edge thereof by thermally pressing the paper sheet.

The printing apparatus of the present invention contains three distinct advantages: first, an image can be printed on a sheet of paper without margins, from the leading edge of the paper sheet to the bottom edge thereof; second, when printing head 22 prints by thermally pressing ink ribbon 25 and paper sheet 16, the printing operation can be stably performed by providing pad member 15 for supporting belt 13 therebetween; and third, when paper sheet 16 is supplied and belt 13 is driven, the friction between pad member 15 and belt 13 can be reduced by interposing an anti-friction member 14 therebetween.

As described above, the printing method and apparatus of the present invention does not require an additional clamp for clamping paper sheet 16 during printing, and is able to print an image without margins from the leading edge of the paper sheet to the bottom edge thereof.

The present invention, is not limited to thermal transfer printers, but can be adapted for use in connection with laser printers, inkjet printers or other types of printers control of the printer can be accomplished through a programmed controller, such as a microprocessor based controller, and known sensors.

The invention has been described through preferred embodiments. However, various modifications can be made without departing from the scope and spirit of the invention as defined by the appended claims.

What is claimed is:

1. A printing apparatus which prints an image on a sheet by thermally pressing an ink ribbon with a printing head, said printing apparatus comprising:

a motor;

a driving roller driven by said motor;

a driven roller spaced apart from said driving roller by a predetermined distance;

a belt wound around said driving roller and said driven roller;

a head conveyor located above said belt and having a printing head;

means for conveying said head conveyor; and means for controlling said head conveyor to cause printing from a leading edge of a sheet to a bottom edge of said sheet when said sheet is disposed on said belt.

2. A printing apparatus as claimed in claim 1, wherein said head conveyor comprises an ink ribbon, a housing for receiving said ink ribbon, and lifting means for raising/lowering said printing head so as to press/release said ink ribbon with said printing head.

3. A printing apparatus as claimed in claim 2, wherein said lifting means comprises a solenoid coupled to said printing head.

4. A printing apparatus as claimed in claim 2, wherein a conveying roller for rolling in contact with said belt is installed in said housing.

5. A printing apparatus as claimed in claim 1, wherein said conveying means comprises a guide rail and a screw disposed in parallel with, a surface of said belt, and a second motor connected to said screw, said screw being threadably engaged with said head conveyor and said head conveyor being slidably supported on said guide rail, thereby allowing said head conveyor to slide along said guide rail in response to rotation of said second motor.

6. A printing apparatus as claimed in claim 1, wherein a pad member is installed between upper and lower portions of said belt, thereby preventing said belt from being deformed due to pressure imported by said printing head.

7. A printing apparatus as claimed in claim 6, wherein an anti-friction member is interposed between said belt and said pad member.

8. A printing apparatus as claimed in claim 1, further comprising means for detecting the leading edge and bottom edge of said sheet so that said printing head can be positioned at either edge of said sheet in response to detection signals generated by said detecting means.

9. A printing apparatus as claimed in claim 8, wherein said detecting means comprises a sensor, for detecting the leading edge and the bottom edge of said sheet, provided in said head conveyor.

10. A printing apparatus as claimed in claim 8, wherein said detecting means comprises a stop provided for restraining leftward and rightward movement of said head conveyor, and a sensor installed on said stop, and wherein said head conveyor is sensed when in contact with said sensor and therefore said printing head is positioned at either edge of said sheet.

* * * * *